US006322446B1

(12) United States Patent
Yacenda

(10) Patent No.: US 6,322,446 B1
(45) Date of Patent: Nov. 27, 2001

(54) SYSTEM AND A METHOD FOR OPERATING ON-LINE STATE LOTTERY GAMES

(75) Inventor: Michael W. Yacenda, Stamford, CT (US)

(73) Assignee: Elot, Inc., Norwalk, CT (US)

( * ) Notice: Subject to any disclaimer, the term of this patent is extended or adjusted under 35 U.S.C. 154(b) by 0 days.

(21) Appl. No.: 09/458,326

(22) Filed: Dec. 10, 1999

(51) Int. Cl.[7] ..... A63F 9/24
(52) U.S. Cl. ..... 463/16; 463/42
(58) Field of Search ..... 463/16–18, 25, 463/29–31, 40–42, 43

(56) References Cited

U.S. PATENT DOCUMENTS 5,398,932 * 3/1995 Eberhardt et al. ..... 273/138 A
5,417,424 * 5/1995 Snowden et al. ..... 273/138 A
5,722,890 * 3/1998 Libby et al. ..... 463/17
6,024,641 * 2/2000 Sarno ..... 463/17
6,146,272 * 11/2000 Walker et al. ..... 463/17
6,154,172 * 11/2000 Piccionelli et al. ..... 342/357.1

* cited by examiner

*Primary Examiner*—Joe H. Cheng
*Assistant Examiner*—Kim T. Nguyen
(74) *Attorney, Agent, or Firm*—F. Chau & Associates, LLP

(57) ABSTRACT

The present invention relates to a system and a method for facilitating state lottery games with a screening and a verification function. A lottery agent system of the present invention includes a plurality of player terminals on which lottery players can play lottery games, including purchasing and receiving lottery tickets, an agent server for facilitating the purchase and screening of players and winning tickets, and a state lottery administrator for providing security or serial numbers for verification. The present invention further discloses a method for claiming awards for the winning tickets upon a drawing of winning numbers. Upon receiving information of the winning tickets, the state provides the agent server with claim validation numbers associated with the winning tickets for claims on lottery awards by winning players.

19 Claims, 4 Drawing Sheets

SYSTEM AND A METHOD FOR OPERATING ON-LINE STATE LOTTERY GAMES

FIELD OF THE INVENTION

The present invention relates to a system and a method for playing lottery games via an electronic network, and more particularly to a system and a method for operating or facilitating on-line state lottery games.

BACKGROUND OF THE INVENTION

In traditional lottery games, lottery players walk into convenience retailers, manually fill out selection slips, and exchange cash or credit with a clerk, who then enters the selections into a lottery terminal. This lottery terminal electronically connects to a central lottery system which manages the lottery games. The central game system then issues a coded lottery ticket, and the lottery ticket is delivered to the lottery players through the local lottery terminal at the retailer. To play conventional lottery games, lottery players are required to travel to retailers and sometimes wait in line to purchase lottery tickets.

Numerous interactive games on the Internet are now available. These include games of wager such as virtual casinos. However, lottery games such as lotteries offered by the states have not been made available on the Internet. One reason may be on the part of the states regarding security and fraud as to forged winning tickets, the age and the state of residence of the players. If state lottery tickets can be purchased by players over publicly accessible electronic or telephonic network such as the Internet, it can be anticipated that many more players will participate in the lottery. Many more tickets will be sold and awards will be much larger.

Therefore, a need exists for a lottery agent system which facilitates lottery play via a electronic network such as through the Internet.

SUMMARY OF THE INVENTION

An object of the present invention is to provide a lottery agent system for facilitating on-line play of state lottery games.

It is another object of the present invention to provide a method for operating online state lottery games with enhanced security.

To accomplish the above and other objects as well as advantages, a lottery agent system of the present invention comprises an agent server connected via the electronic network to a plurality of player terminals and to a state lottery administrator, wherein the agent server is configured for receiving player and ticket information transmitted from the player terminals, for transmitting the ticket information to the state lottery administrator, and for receiving security or serial numbers associated with each lottery ticket; a database in the agent server for storing the player and ticket information and the security or serial numbers issued by the state lottery administrator in association with each lottery ticket; and a screening unit in the agent server, having criteria required by the state pre-stored therein, for verifying that each player satisfies the criteria prior to transmitting the ticket information to the state lottery administrator. The lottery agent system further includes a verification unit in the agent server for receiving winning numbers drawn by the state and for comparing the winning numbers with the ticket information stored in the database to determine if there are any winning lottery tickets of which numbers match the winning numbers. The verification unit verifies serial numbers of the winning tickets with the serial numbers previously stored in the database. The criteria includes a minimum age and residency within the border of the state. The agent server may further include means for transmitting information of the winning lottery tickets to the state lottery administrator, and for receiving claim validation numbers associated with the winning lottery tickets from the state lottery administrator. The agent server is configured to transmit to the player terminals lottery game data upon confirmation of purchase of a lottery ticket from the state lottery administrator, whereby an image in the form of a lottery ticket including ticket numbers selected by the player and the associated security or serial numbers is displayed on the player terminal of the player.

The lottery agent system further includes a banking server and a banking database for storing player account information, wherein the banking server debits a player's account when the player purchases a lottery ticket and credits the player's account with a winning amount upon a win from the lottery ticket, and the banking server communicates and transmits the debits and credits of money with the state lottery administrator. The banking server also communicates with a credit card provider of the player and debits and credits a credit card account of the player upon purchase of a lottery ticket or a win from a lottery ticket purchased by the player.

The present invention also provides a method for conducting state lottery play over an electronic network, comprising the steps of receiving player and ticket information entered by lottery players, verifying that the lottery players satisfy criteria required by the state, storing the player and ticket information of the verified lottery players, receiving security or serial numbers issued by a state wherein each security or serial number is associated with each lottery ticket, receiving winning numbers from the state, determining winning tickets by comparing the winning numbers with ticket numbers entered by the verified lottery players, and verifying the winning tickets with the security or serial numbers. The method of the present invention further includes the steps of crediting a winning amount of each corresponding winning ticket to an account of each winning player and debiting accounts of the verified players for purchases of the lottery tickets. The step of verifying includes comparing the player information with the criteria. The security or serial numbers are issued by the state upon receiving the ticket information by the state.

The method of the present invention may further include transmitting information of the winning tickets to the state, which includes the serial numbers associated with the winning tickets, and receiving claim validation numbers associated with the winning tickets from the state, wherein the claim validation numbers are issued by and stored in the state.

The method of the present invention may further include providing the claim validation numbers to each winning player, claiming a predetermined winning amount by submitting the claim validation numbers, verifying the submitted claim validation numbers with the claim validation numbers stored in the state, and rewarding the winning amount to the each winning player. The method according to the present invention may further include determining whether the winning amount is over a certain amount of money. The method of the present invention may further include providing a claim form to each winning player via the electronic network, printing and completing the claim form, and submitting the claim form to claim the winning amount.

These and other objects, features and advantages of the present invention will become apparent from the following detailed description of illustrative embodiments thereof, which is to be read in connection with the accompanying drawings.

BRIEF DESCRIPTION OF THE DRAWINGS

This disclosure will present in detail the following description of preferred embodiments with reference to the following figures wherein.

DESCRIPTION OF THE PREFERRED EMBODIMENTS

Figure 1:
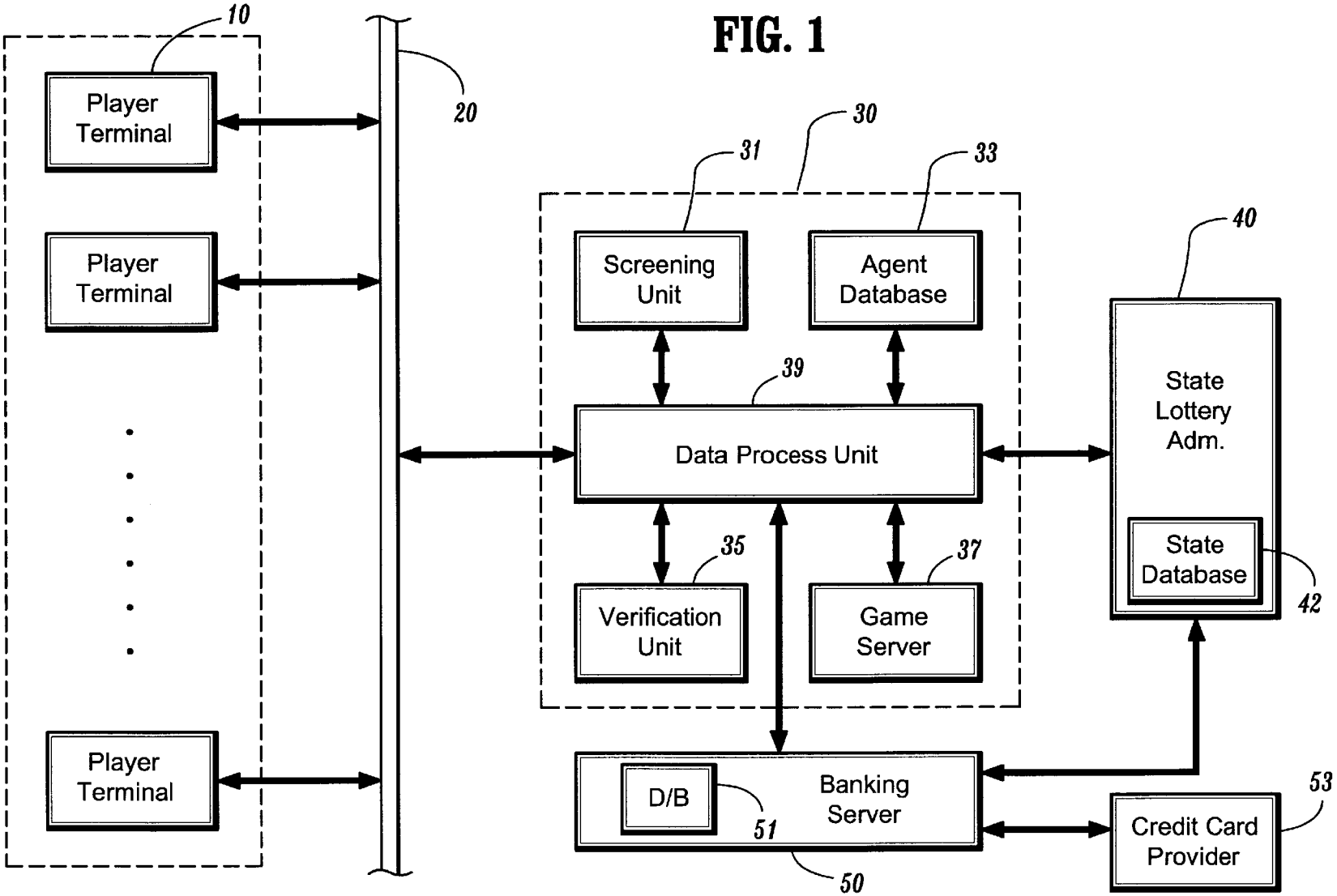
FIG. 1 is a block diagram illustrating a preferred embodiment of a lottery agent system according to the present invention.

The present disclosure describes a lottery agent system for facilitating lottery games which makes it possible to purchase lottery tickets and to play lottery games at player terminals through a communication network. The lottery agent system of the present invention more particularly relates to playing lottery games provided by the states, and the system has an agent server for interacting with lottery players and lottery administrators of the states to manage and facilitate the state lottery games. For example, lottery players access the agent server via the Internet to purchase lottery tickets at the player terminals, such as personal computers or lottery terminals, for playing lottery games. The lottery players enter player information, such as names, addresses, ages, and accounts of the lottery players, and ticket information of the lottery tickets to be purchased. The accounts may be credit card accounts or bank accounts of the lottery players, or separate accounts established by the agent server for the lottery players for the use of lottery games. Upon receiving the player and ticket information, the agent server verifies based on the player information of the lottery players that each lottery player satisfies certain criteria required by the state.

After such verification of the lottery players, the agent server sends the ticket information via the Internet to each state lottery administrator which then provides the agent server with security or serial numbers associated with each lottery ticket purchased. The security or serial numbers (hereinafter referred to as "serial numbers") are preferably encrypted numbers. Each ticket sold is assigned a unique serial number by the state. The agent server transmits lottery game data to the player terminals of the lottery players upon confirmation of the purchase of the lottery tickets.

Upon drawing winning numbers, the agent server verifies winning tickets of which ticket numbers match the winning numbers, based on the serial numbers received from the state lottery administrator. The agent server then notifies the lottery players of the verified winning tickets.

The agent server also transmits to the state lottery administrator the ticket information of the winning tickets including the serial numbers associated with the winning tickets. The state lottery administrator verifies the ticket information received from the agent server with the ticket information previously stored in a state database. Upon a successful verification, the state lottery administrator issues claim validation numbers associated with the verified winning tickets for the future claims on lottery awards by winning players. The claim validation numbers issued by the state lottery administrator are stored in the state database and transmitted to the agent server.

The lottery agent system may also include a banking server which interacts with the agent server and the each state lottery administrator and credits an account of each winning player with a winning amount provided by the each state administrator and debits the account for purchase of the lottery tickets.

Thus, a lottery agent system of the present invention performs a screening and a verification process. Preferably, upon receiving the player and ticket information, the agent server screens each lottery player for satisfaction of criteria set by the states. Upon purchase of a ticket, the serial number associated with each ticket is stored. Upon a drawing of winning numbers, the agent server verifies winning tickets with the players information, serial numbers and validation numbers issued by each state administrator and stored in a database of the agent server.

FIG. 1 shows a preferred embodiment of a lottery agent system according to the present invention. Player terminals 10 are used by lottery players to enter information for playing lottery games. The player terminals 10 may be personal computers of the lottery players and/or lottery terminals specific for playing lottery games and located at readily accessible places. To purchase lottery tickets, the lottery players enter at the player terminals 10 player information, such as ages and addresses, accounts of the lottery players and ticket information, such as types and numbers of lottery tickets to be purchased. The player and ticket information is transferred via a communication network 20 to an agent server 30. The communication network 20 may be a global electronic network such as the Internet through which a lottery website is provided for the lottery players to log on.

The agent server 30 includes a screening unit 31 for verifying based on the player information that each lottery player satisfies certain criteria required for playing lottery games, an agent database 33 for storing the player and ticket information and serial numbers generated by a state lottery administrator 40, a verification unit 35 for verifying winning tickets based on the ticket information and the serial numbers after a drawing of winning numbers, a game server 37 for storing and providing various types of lottery games, and a data process unit 39 for communicating control and data signals with the above and other components of the agent server 30. Detail description of the agent server 30 in FIG. 1 follows.

When a lottery player enters his/her player and ticket information at a player terminal 10 to purchase lottery tickets, the screening unit 31 receives the player and ticket information and verifies based on the player information that the lottery player satisfies certain criteria required by the state. The criteria, for example, minimum age and residency within the border of the state, are set by the state as a condition to purchase lottery tickets. Such criteria may be previously stored in the screen unit 31. For the verification, the screening unit 31 compares the criteria with the player information to confirm that each and every requirement of the criteria is satisfied with each corresponding data of the player information. For example, the screen unit 31 performs comparison and determination with respect to whether the lottery player's age is over the minimum age, whether the lottery player's address falls within the border of the state, and so on. If the player information is successfully verified by the screening unit 31, the verified player information along with the ticket information is stored in the agent database 33 under the control of the data process unit 39. Upon such verification, the ticket information is transmitted to the state lottery administrator 40 under the control of the data process unit 39. Upon receiving and storing the ticket information in a state database 42, the state lottery administrator 40 issues serial numbers associated with the lottery tickets to be purchased in accordance with the ticket information. Each of the serial numbers is associated with each of the lottery tickets to be purchased. That is, each serial number is unique to each lottery ticket to be purchased. The serial numbers are then transmitted to and stored in the agent database 33 under the control of the data process unit 39.

Upon receiving the serial numbers associated with the lottery tickets from the state lottery administrator 40, the data process unit 39 confirms the purchases of the lottery tickets and generates control signals to the game server 37 for playing lottery games. In response to the control signals from the data process unit 39, the game server 37 provides the player terminal 10 with image data in the form of the lottery tickets purchased. The player terminal 10 displays on its screen virtual lottery tickets corresponding to the image data of the lottery tickets purchased. The image data may include ticket numbers selected by the lottery player and the serial numbers associated with the lottery tickets. The game server 37 may previously store image data of various types of lottery tickets. The lottery player can then play lottery games with the virtual lottery tickets displayed on the player terminal 10. That is, the lottery player observes a drawing of winning numbers and matches between the winning numbers and the ticket numbers of the virtual lottery tickets. The lottery player can also interactively communicate with the agent server 30 via the Internet 20 while playing lottery games.

After winning numbers are drawn, the state lottery administrator 40 provides the winning numbers to the agent sever 30 or the winning numbers are entered into the agent server 30 after they are publicly announced. The verification unit 35 receives the winning numbers and determines if there are any winning lottery tickets of which ticket numbers match the winning numbers. For the determination, the verification unit 35 accesses the ticket information stored in the agent database 33 which includes the ticket numbers of the lottery tickets purchased. The verification unit 35 then compares the respective ticket numbers with the winning numbers to determine the winning lottery tickets.

Upon determining the winning lottery tickets, the verification unit 35 verifies the winning lottery tickets with the serial numbers previously issued by the state lottery administrator 40. For the verification, the verification unit 35 accesses the serial numbers stored in the agent database 33. Since each of the serial numbers is previously issued in association with each of the purchased lottery tickets and stored in the agent database 33, each of the winning lottery tickets can be verified by confirming the serial numbers of the winning lottery tickets with the corresponding serial numbers retrieved from the agent database 33.

Upon being successfully verified with the corresponding serial numbers, information of the winning lottery tickets including the serial numbers are transmitted from the agent database 33 to the state lottery administrator 40 under control of the data process unit 39. Upon receiving the information and the serial number of the winning tickets, the state lottery administrator 40 issues claim validation numbers associated with the winning tickets. Each of the claim validation numbers is unique to each of the winning tickets. The issued claim validation numbers are stored in the state database 42.

The claim validation numbers are transmitted from the state lottery administrator 40 and stored in the agent database 33 under control of the data process unit 39. The agent server 30 also provides the claim validation numbers to the player terminals 10 of the winning players. Upon receiving the claim validation numbers, the winning players are qualified to claim predetermined lottery awards. That is, the winning players can obtain a print of claim form including the claim validation numbers at the player terminals 10, and then claim the predetermined lottery awards by completing and submitting the claim form to the state lottery administrator 40. Upon receiving the claim form with the claim validation numbers, the state lottery administrator 40 accesses the corresponding claim validation numbers previously stored in the state database 42 to verify the claim form and the claim validation numbers received. After successful verification of the claim form and the claim validation numbers, the state lottery administrator 40 allows the banking server 50 to reward the predetermined lottery awards under control of the data process unit 39 to the claimants, i.e., the winning players.

The lottery agent system of the present invention further includes the banking server 50 for crediting and debiting the accounts of the lottery players. The accounts for the use of playing lottery games may be credit card accounts or bank accounts of the lottery players, or separate accounts previously established for the lottery players. Such accounts may be stored in the database 51 of the banking server 50. The banking server 50 credits the accounts of the respective lottery players who own the winning tickets and claim predetermined lottery awards, and debits the accounts of the respective lottery players for the purchases of the lottery tickets. At the time of every credit or debit, the banking server 50 updates the corresponding accounts in the banking database 51. The banking server 50 may directly communicate with credit card providers 53 of the lottery players. That is, the banking server 50 debits and credits credit card accounts of the lottery players upon purchases of the lottery tickets or wins from the lottery tickets purchased.

Figure 2A:
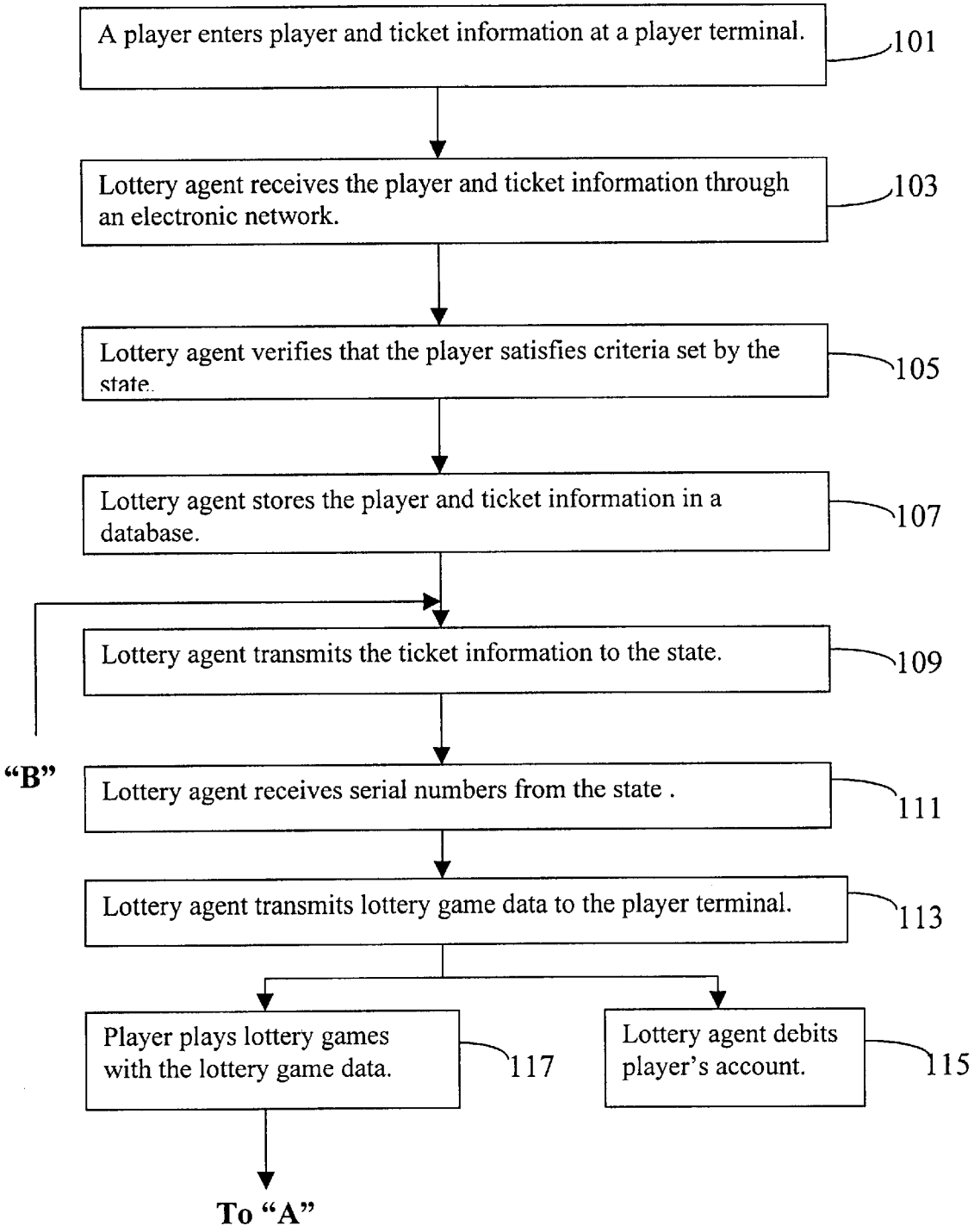
FIG. 2A and 2B are flow charts describing a method for operating on-line state lottery games according to the present invention.
Figure 2B:
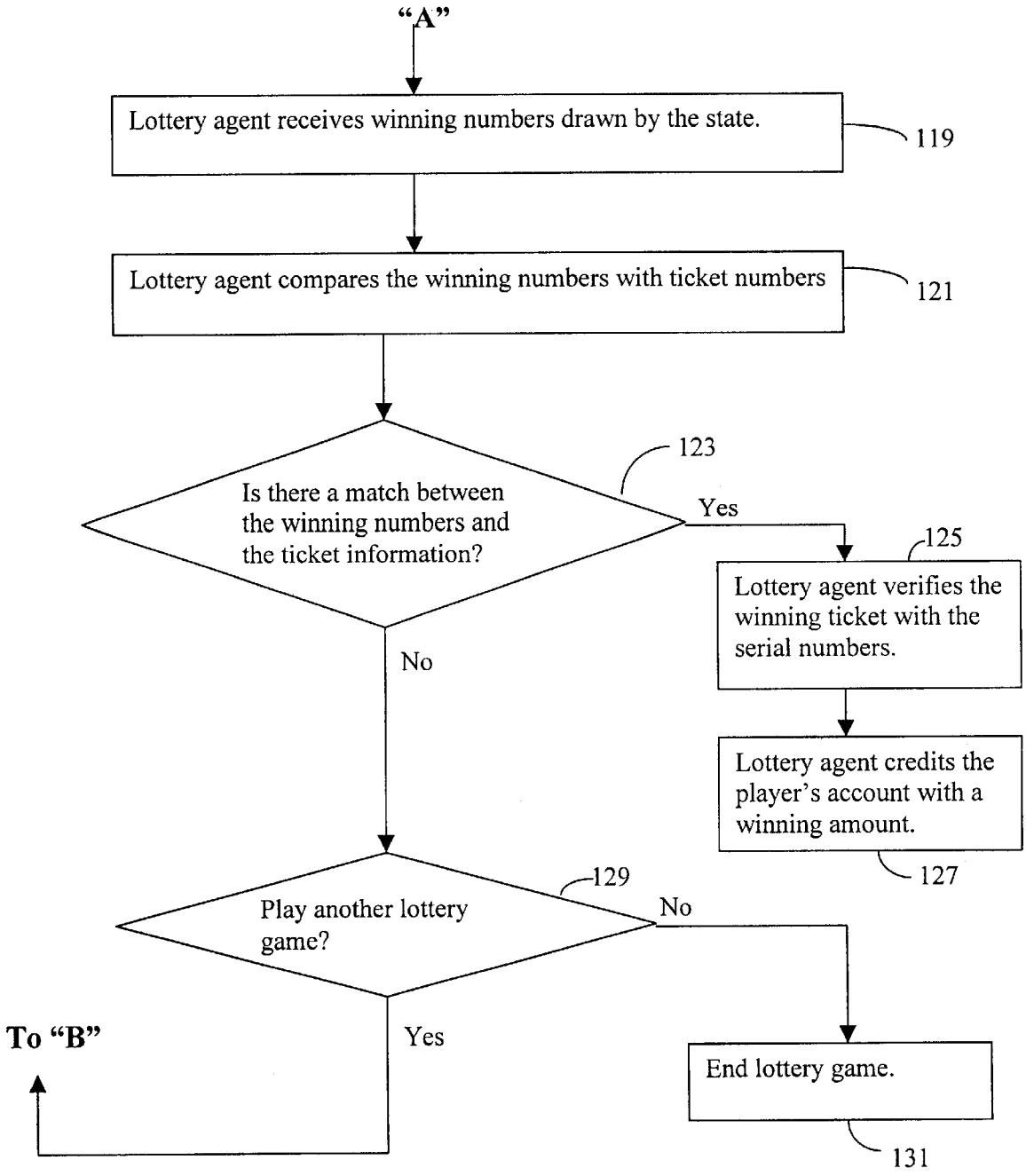

Referring to FIGS. 2A and 2B, a flowchart illustrates a method for facilitating play of on-line state lottery games. To purchase lottery tickets, a lottery player enters his/her player information and ticket information at a player terminal (step 101). The player information includes name, age, address, and account information of the lottery player. The ticket information includes types and numbers of the lottery tickets to be purchased by the lottery player. A lottery agent receives the player and ticket information through an electronic network, such as the Internet (step 103), and verifies that the lottery player satisfies certain criteria required by the state to purchase the state lottery tickets (step 105). For example, the state may require in the criteria that a lottery player must be at least 18-year old and resident in the state.

The lottery agent stores the player and ticket information of the verified player in a database (step 107), and transmits the ticket information to the state, i.e., a state lottery administrator (step 109). The state lottery administrator then issues serial numbers associated with the ticket information after confirming the purchase of the state lottery tickets by the lottery player (step 111). The issued serial numbers each of which is unique to each of the purchased lottery tickets are transmitted to the lottery agent. After receiving the serial numbers, the lottery agent transmits to the player terminal lottery game data including image data of the lottery tickets (step 113), and at the same time the lottery agent debits the player's account for the purchase of the lottery tickets (step 115) with the lottery game data, the player terminal displays virtual lottery tickets corresponding to the lottery tickets purchased including ticket numbers selected by the player and associated with the serial numbers. The player then plays a lottery game with the virtual lottery tickets displayed on the player terminal (step 117).

After winning numbers are drawn by the state and transmitted to the lottery agent (step 119), the lottery agent compares the winning numbers with the ticket numbers selected by the lottery player (step 121). If there is any match between the winning numbers and the ticket numbers (step 123), the lottery agent verifies the winning ticket with the serial numbers received from the state lottery administrator (step 125). With respect to the verified winning ticket, the lottery agent credits the player's account with a winning amount provided by the state lottery administrator (step 127). If there is no match between the winning numbers and the ticket numbers in the step 123, the lottery agent asks the lottery player whether to play another lottery game (step 129). If the lottery player chooses not to continue lottery game, the lottery agent ends the player's lottery game (step 131). If the lottery player chooses to play another lottery game, the lottery agent again transmits the ticket information to the state lottery administrator (step 109). Then, the state lottery administrator issues new serial numbers associated with new lottery tickets and provides the new serial numbers to the lottery agent (step 11). Upon receiving the new serial numbers, the lottery agent repeats the steps 113 to 131 as described above.

Figure 3:
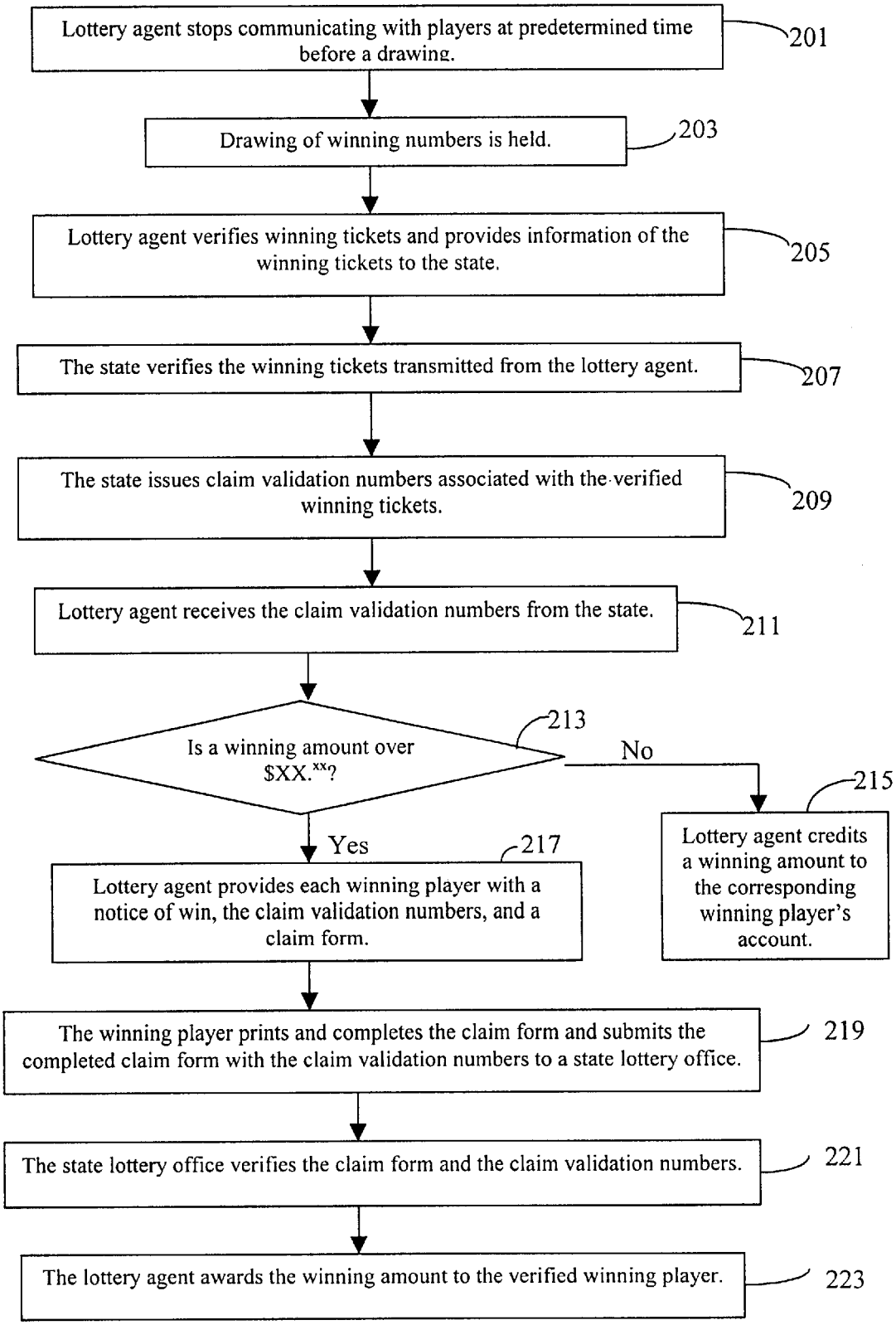
FIG. 3 is a flow chart describing a series of steps for claiming awards for winning lottery tickets.

Referring to FIG. 3, a flow chart illustrates a series of steps for claiming awards for wins in playing lottery games. At predetermined time before a drawing of winning numbers, a lottery agent managing the lottery games stops communicating with lottery players (step 201). Thus, the lottery players cannot purchase lottery tickets after a predetermined time before a drawing of the winning numbers. After the winning numbers are drawn so that winning tickets are determined (step 203), the lottery agent verifies the winning tickets with the ticket information previously provided by the lottery player and provides the information of the winning tickets to the state (step 205). The verification of the winning tickets includes confirming the winning tickets with serial numbers previously issued by the state in association with the respective winning tickets.

Upon receiving the information of the winning tickets, the state verifies the winning tickets with the ticket information previously stored in a database of the state (step 207). The state then issues claim validation numbers each of which is associated with each of the verified winning tickets (step 209). The claim validation numbers are stored in the state and transmitted to the lottery agent (step 211).

Upon receiving the claim validation numbers associated with the winning tickets, the lottery agent determines whether a winning amount of each winning ticket is over a certain amount of money (step 213). If the winning amount is not over a certain amount of money, the lottery agent credits the winning amount to an account of the corresponding winning player (step 215). If the winning amount is over a certain amount of money, the lottery agent provides each winning player with a notice of win, the claim validation numbers, and a claim form, preferably, via the Internet (step 217). The winning player then prints and completes the claim form and submits the completed claim form with the claim validation numbers to a state lottery office administering the state lottery games (step 219). The state lottery office verifies the claim validation numbers submitted by the winning player with the corresponding claim validation numbers previously stored in the state (step 221). Upon verifying the claim validation numbers, the state allows the lottery agent to award the winning amount to the winning player (step 223).

Thus, the system and the method for operating on-line state lottery games according to the present invention provides the lottery players with not only convenient and readily accessible lottery play but also more reliable security on the information for playing the state lottery games. Therefore, the present invention may facilitate lottery games so as to encourage patrons to play lottery games more frequently.

Having described preferred embodiments of a system and a method for playing electronic lottery games according to the present invention, it is noted that modifications and variations can be made by persons skilled in the art in light of the above teachings.

Therefore, it is noted that modifications and variations can be made by persons skilled in the art in light of the above teachings. It is also to be understood that the above embodiments are intended to be illustrative, and that any changes may be made in the particular embodiments disclosed, which are within the scope and spirit of the invention as outlined by the appended claims.

What is claimed is:

1. A lottery agent system for facilitating state lottery play over an electronic network, comprising:

an agent server connected via said electronic network to a plurality of player terminals and to a state lottery administrator, said agent server being configured for receiving player and ticket information transmitted from said player terminals, for transmitting said ticket information to said state lottery administrator, and for receiving serial numbers issued by said state lottery administrator in association with each lottery ticket;

a database in said agent server for storing said player and ticket information and said serial numbers associated with each lottery ticket; and a screening unit in said agent server, having criteria required by the state pre-stored therein, for verifying that each player satisfies said criteria prior to transmitting said ticket information to said state lottery administrator.

2. The system according to claim 1, further including a verification unit in said agent server for receiving winning numbers drawn by the state and for comparing said winning numbers with said ticket information stored in said database to determine if there are any winning lottery tickets of which numbers match said winning numbers.

3. The system according to claim 2, wherein said verification unit verifies serial numbers of said winning lottery tickets with said serial numbers previously stored in said database.

4. The system according to claim 2, wherein said agent server includes means for transmitting information of said winning lottery tickets to said state lottery administrator, and for receiving claim validation numbers associated with said winning lottery tickets from said state lottery administrator.

5. The system according to claim 1, further including a banking server and a banking database for storing player account information, said banking server for debiting a player's account when said player purchases a lottery ticket and for crediting said player's account with a winning amount upon a win from said lottery ticket, said banking server for communicating and transmitting debits and credits of money with said state lottery administrator.

6. The system according to claim 5, wherein said banking server communicates with a credit card provider of said player and debits and credits a credit card account of said player upon purchase of a lottery ticket or a win from a lottery ticket purchased by said player.

7. The system according to claim 1, wherein said criteria includes a minimum age and residency within the border of the state.

8. The system according to claim 1, wherein said agent server is configured to transmit to said player terminals lottery game data upon confirmation of purchase of a lottery ticket from said state lottery administrator, whereby an image in the form of a lottery ticket including ticket numbers selected by said player and said associated serial numbers is displayed on said player terminal of said player.

9. The system according to claim 1, wherein said electronic network is Internet.

10. A method for conducting state lottery play over an electronic network, comprising the steps of:

receiving player and ticket information entered by lottery players;

verifying that said lottery players satisfy criteria required by the state;

storing said player and ticket information of said verified lottery players;

receiving serial numbers issued by a state, each serial number being associated with each lottery ticket;

receiving winning numbers from said state;

determining winning tickets by comparing said winning numbers with ticket numbers entered by said verified lottery players; and verifying said winning tickets with said serial numbers.

11. The method according to claim 10, further including the step of crediting a winning amount of each winning ticket to an account of each corresponding winning player.

12. The method according to claim 10, further including the step of debiting accounts of said verified players for purchases of said lottery tickets.

13. The method according to claim 10, wherein said criteria includes a minimum age and residency within border of said state.

14. The method according to claim 10, wherein the step of verifying includes comparing said player information with said criteria.

15. The method according to claim 10, wherein said serial numbers are issued by said state upon receiving said ticket information by said state.

16. The method according to claim 10, further includes the steps of:

transmitting information of said winning tickets to the state, said information including said serial numbers associated with said winning tickets; and receiving claim validation numbers associated with said winning tickets from the state, said claim validation numbers being issued by and stored in the state.

17. The method according to claim 16, further including the steps of:

providing said claim validation numbers to each winning player;

claiming a predetermined winning amount by submitting said claim validation numbers;

verifying said submitted claim validation numbers with said claim validation numbers stored in the state; and rewarding said winning amount to said each winning player.

18. The method according to claim 17, wherein the step of providing said claim validation numbers includes determining whether said winning amount is over a certain amount of money.

19. The method according to claim 17, further includes the steps of:

providing a claim form to said each winning player via said electronic network;

printing and completing said claim form; and submitting said claim form to claim said winning amount.

* * * * *